US009251754B2

(12) United States Patent
Ma

(10) Patent No.: US 9,251,754 B2
(45) Date of Patent: Feb. 2, 2016

(54) GATE DRIVING CIRCUIT AND LIQUID CRYSTAL DISPLAY

(75) Inventor: Zhanjie Ma, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1520 days.

(21) Appl. No.: 11/957,806

(22) Filed: Dec. 17, 2007

(65) Prior Publication Data

US 2008/0259010 A1 Oct. 23, 2008

(30) Foreign Application Priority Data

Apr. 17, 2007 (CN) ..... 2007 1 0065591

(51) Int. Cl.
*G09G 3/36* (2006.01)

(52) U.S. Cl.
CPC ..... *G09G 3/3674* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 6,049,319 | A * | 4/2000 | Sakamoto et al. | 345/94 |
| 7,126,597 | B2 | 10/2006 | Shino et al. | |
| 7,133,034 | B2 * | 11/2006 | Park et al. | 345/204 |
| 2003/0025687 | A1 * | 2/2003 | Shino et al. | 345/204 |
| 2004/0189573 | A1 * | 9/2004 | Lee et al. | 345/94 |
| 2006/0114216 | A1 * | 6/2006 | Shim | 345/100 |

FOREIGN PATENT DOCUMENTS

CN 1363919 A 8/2002

* cited by examiner

*Primary Examiner* — Seokyun Moon
(74) *Attorney, Agent, or Firm* — Ladas & Parry LLP

(57) ABSTRACT

The present invention relates to a gate driving circuit comprising at least an output processing unit, and further comprising an amplifying device correspondingly connected to the output processing unit, said amplifying device being used to process a signal output from the output processing unit and then output a driving signal. The present invention also relates to a liquid crystal display, including a gate driving circuit and a display panel, said gate driving circuit comprising at least an output processing unit, and said display panel comprising a gate line, wherein said gate driving circuit further comprises an amplifying device correspondingly connected to the output processing unit, said amplifying device is used to process a signal output from the output processing unit and then output a driving signal; said amplifying device is correspondingly connected to an end of the gate line. The invention decreases the difference of output signals of the gate driving circuit at difference positions, improves overall uniformity of the gate driving signals, thus decreasing display deviation on the display panel and improving imaging effect.

8 Claims, 3 Drawing Sheets

GATE DRIVING CIRCUIT AND LIQUID CRYSTAL DISPLAY

FIELD OF THE INVENTION

The present invention relates to a liquid crystal display technology, and particularly to a gate driving circuit and a liquid crystal display.

BACKGROUND OF THE INVENTION

Thin Film Transistor-Liquid Crystal Display, and TFT-LCD for short, is one of main liquid crystal displays. An objective of such liquid crystal displays is to increase size and resolution of the liquid crystal display panel. As the liquid crystal display panel becomes larger in size and higher in resolution, the density of gate lines in the panel is required to increase.

When the density of gate lines in the panel increases, the number of output processing units in the gate driving circuit increases accordingly. In the related art, the gate driving circuit converts input signal into output signal directly. In an ideal condition, when the same signals are input to the gate driving circuit, the same signals will be output at output pins on the output processing unit in the gate driving circuit. However, due to the property of process, it is hard to design respective output processing units within the gate driving circuit to have the same resistance. In such a case, when the same signals are input, the outputs will be different due to resistance difference among the respective output processing units within the gate driving circuit, and further results in inconsistence of signals input to the gate which brings defects of a great displaying deviation and bad imaging effect, such as uneven resolution, grey difference occurring at a display vicinity of two output processing units, bright line appearing, and the like.

In the related art, in order to solve the above technical problems, a method in which the width of line connecting the output processing units is made greater and resistance becomes smaller relatively so as to decrease output difference of respective output processing units within the gate driving circuit is applied. However, a defect of this method is that more peripheral spaces of the liquid crystal display need to be occupied, while requirement for the space layout and size of the liquid crystal display and the design difficulty will increase.

SUMMARY OF THE INVENTION

An object of the present invention is to provide a gate driving circuit and a liquid crystal display which can decrease the resistance difference of the output processing units within the gate driving circuit such that gate driving signals output by the gate driving circuit keep consistent with each other to the most extent, and can decrease peripheral spaces of the liquid crystal display to be occupied, and reduce the requirement for space layout and size and the design difficulty of the liquid crystal display.

To achieve the above object, the invention provides a gate driving circuit comprising at least an output processing unit, and further comprising an amplifying device correspondingly connected to the output processing unit, said amplifying device being used to process a signal output from the output processing unit and then output a driving signal.

The invention also provides a liquid crystal display, including a gate driving circuit and a display panel, said gate driving circuit comprising at least an output processing unit, and said display panel comprising a gate line, wherein said gate driving circuit further comprises an amplifying device correspondingly connected to the output processing unit, wherein said amplifying device is used to process a signal output from the output processing unit and then output a driving signal; said amplifying device is correspondingly connected to an end of the gate line.

Therefore, respective aspects of the invention have advantages as following:

1. by adding an amplifying device to the output terminal of the gate driving circuit, the output difference in output processing units within the gate driving circuit decreases such that the gate driving signals output from the gate driving circuit keep consistent with each other to the most extent.

2. due to improvement in structure of the gate driving circuit, the gate driving signals received by the gate lines in the display panel keep consistent with each other to the most extent, thus improving overall uniformity of the gate driving signals, decreasing display deviation on the display panel and improving imaging effect.

3. due to avoiding the method of increasing the width of lines connecting the output processing units to decrease the output difference in different output processing units, the peripheral spaces of the liquid crystal display to be occupied can be decreased, and the requirement for space layout and size as well as the design difficulty of the liquid crystal display can be reduced.

DETAILED DESCRIPTION

Hereinafter, the technical solution of the invention is further described in detail in conjunction with figures and embodiments.

Figure 1:
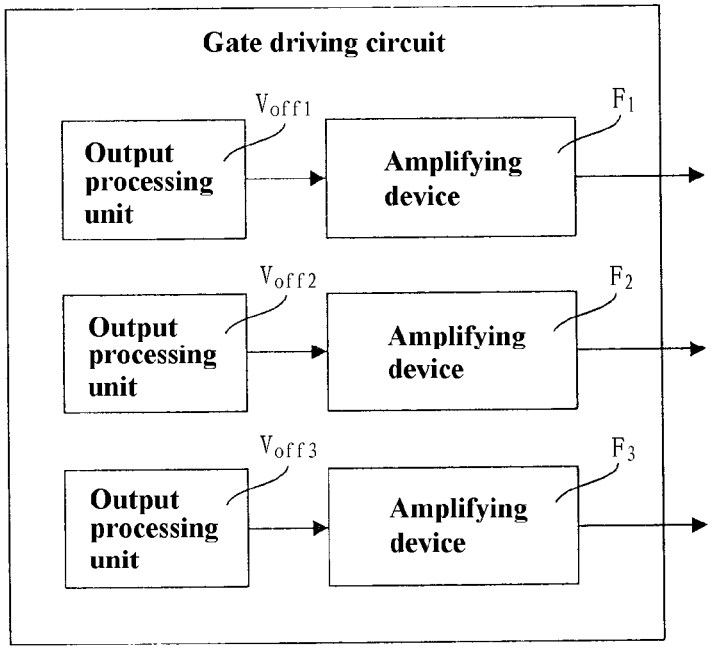
FIG. 1 is a structural schematic diagram of Embodiment 1 of the gate driving circuit of the invention.

The invention provides a gate driving circuit, comprising at least an output processing unit, and further comprising an amplifying device connected to the output processing unit one by one, and the amplifying device is used to process a signal output from the output processing unit and then output a driving signal. FIG. 1 is a structural schematic diagram of Embodiment 1 of the gate driving circuit of the invention. Hereinafter, the principle of the gate driving circuit of the invention will be explained by example of three output processing units. The gate driving circuit comprises output processing units $V_{off}$1, $V_{off}$2, $V_{off}$3, and amplifying devices F1, F2, F3. The output processing units $V_{off}$1, $V_{off}$2, $V_{off}$3 are connected to the amplifying devices F1, F2, F3 one by one. When the same signals are input to respective output processing units, due to the property of process, it is hard to design respective output processing units within the gate driving circuit to have the same resistance, thus the outputs of the gate driving circuit will be different due to the resistance difference among respective output processing units within the gate driving circuit.

The invention decreases output difference in the output processing units within the gate driving circuit such that the gate driving signals output from the gate driving circuit keep consistent with each other to the most extent by adding the amplifying devices for compensating for the output difference of the output processing units at the output terminal of the output processing units. Also, as compared to the technology of increasing the width of line connecting the output processing units to reduce resistances of the output processing units wherein the reduced resistances of respective output processing units decrease the output difference of the output processing units within the gate driving circuit, this embodiment can achieve the object of reducing the output difference of the gate driving circuit, and decreases peripheral spaces of the liquid crystal display to be occupied, and reduces the requirement for the space layout and size and the design difficulty of the liquid crystal display.

Figure 2:
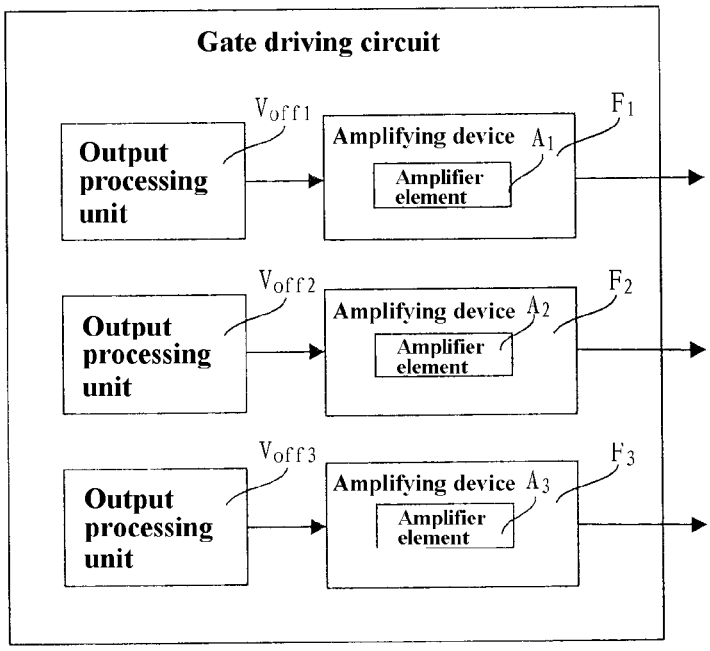
FIG. 2 is a structural schematic diagram of Embodiment 2 of the gate driving circuit of the invention.

FIG. 2 is a structural schematic diagram of Embodiment 2 of the gate driving circuit of the invention. The amplifying device in this embodiment comprises an amplifier element. As shown in FIG. 2, amplifier elements A1, A2, A3 are correspondingly arranged in the amplifying devices F1, F2, F3. When signals output from the output processing units $V_{off}$1, $V_{off}$2, $V_{off}$3 are different, the multiples of the amplifier elements A1, A2, A3 in the amplifying devices F1, F2, F3 which are connected to the output processing units $V_{off}$1, $V_{off}$2, $V_{off}$3 one by one need to be adjusted so that the amplifying devices F1, F2, F3 output the same signals. This embodiment can mostly reduce the difference among output signals from the gate driving circuit by adjusting the amplifying multiples of the amplifier elements in the amplifying devices. By the method of adjusting the amplifying multiples of the amplifier elements to adjust the output signals of the amplifying devices, it is possible to increase process complicacy of module bonding of the gate driving circuit and the display panel, and reduce manufacture effectiveness.

Figure 3:
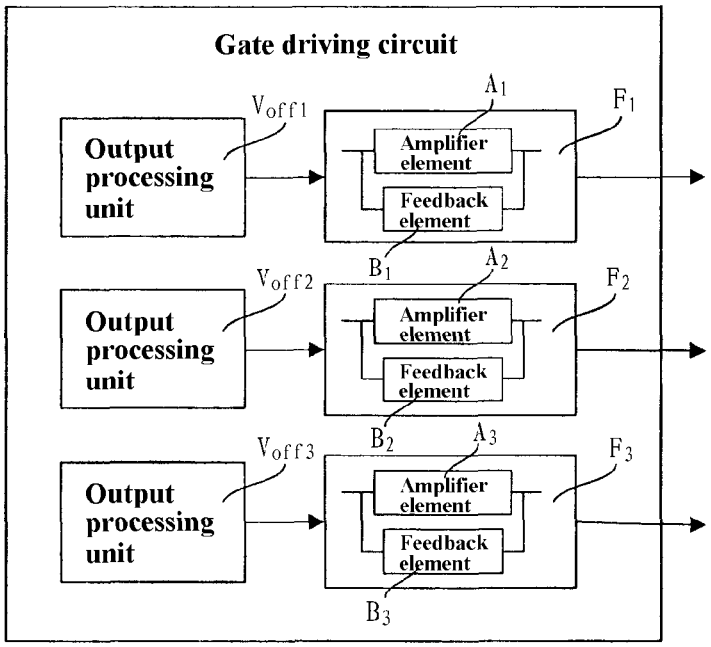
FIG. 3 is a structural schematic diagram of Embodiment 3 of the gate driving circuit of the invention.

To reduce the process complicacy of module bonding to improve manufacture effectiveness, as the schematic diagram of Embodiment 3 of the gate driving circuit shown in FIG. 3, the amplifying devices F1, F2, F3 further comprises feedback elements B1, B2, B3 respectively, which are connected in parallel with the amplifier elements A1, A2, A3 respectively to form feedback loops. For example, after an output signal of the output control module $V_{off}$1 is input to the amplifier element A1, if the signal is below a preset level, it will not be output, but pass through the feedback element B1 in the feedback loop. Again, the amplified signal is amplified by the amplifier element A1. After cycling as such, the signal will not be output by the amplifying device until the output signal reaches the preset level. When the same preset level is set for different amplifying devices, the different amplifying devices will output the same signals, so as to ensure the gate-consistent signals. This embodiment adds in the feedback elements connected in parallel with the amplifier elements such that an expected output may be achieved by the automatic adjust in internal circuit of the amplifying device, so improves the process effectiveness of module bonding.

Figure 4:
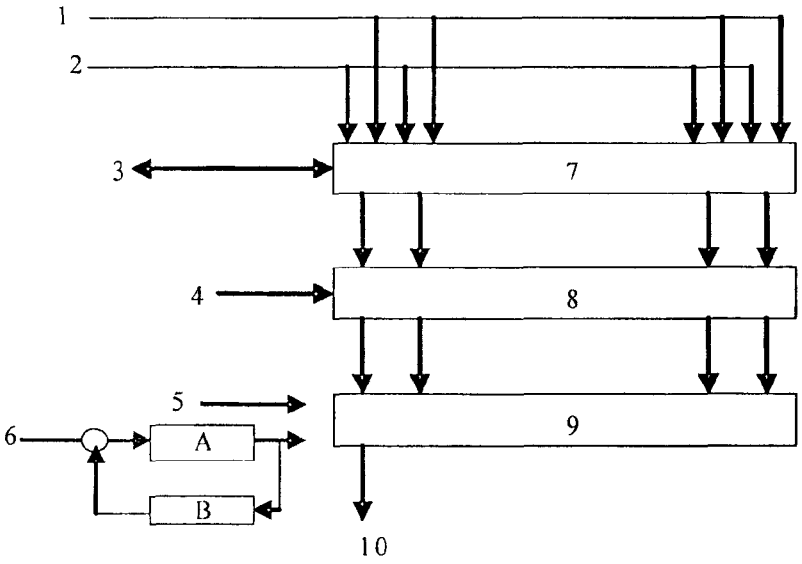
FIG. 4 is an operation flowchart of the gate driving circuit of the invention.

In an actual operation, the output signals of the amplifying device in the above embodiments need to subject to an output buffering process before the output signals are input to the gate as gate driving signals. FIG. 4 is an operation flowchart of the gate driving circuit of the invention, in which 1 represents an U/D input signal, 2 represents a CPV input signal, 3 is a DI/O input signal, 4 indicates an OE input signal, 5 is a VGG input signal, 6 is a signal output from the output processing device, 7 represents a register such as 300 Shift Register, 8 is a level shifter such as Level Shifter, 9 is an output buffer such as 900 Output Buffer; and 10 indicates a gate line. "A" represents an amplifier element and "B" represents a feedback element. After the signal 6 output from the output processing device enters into the amplifier element, if the signal is below a preset level, it will not be output to the 300 Output Buffer 9, but pass through the feedback element B in the feedback loop. Again, the amplified signal is amplified by the amplifier element A. After cycling as such, the signal will not be output to the 300 Output Buffer 9 until the output signal reaches the preset level, such that the signals input to the gate line 10 will be consistent with each other. When the enabling signal of the gate driving circuit is set to the same as the preset level, the gate will obtain identical input signals.

The invention also provides a liquid crystal display including a gate driving circuit and a display panel, said gate driving circuit comprising at least one output processing unit, said display panel comprising a gate line, wherein said gate driving circuit further comprises amplifying devices of which the number corresponds to the number of the output processing unit, and each of the amplifying devices is connected to the output processing unit, and is used to process signals output from the output processing unit and then output a driving signal. Each of the amplifying devices is connected to one end of the gate line.

Figure 5:
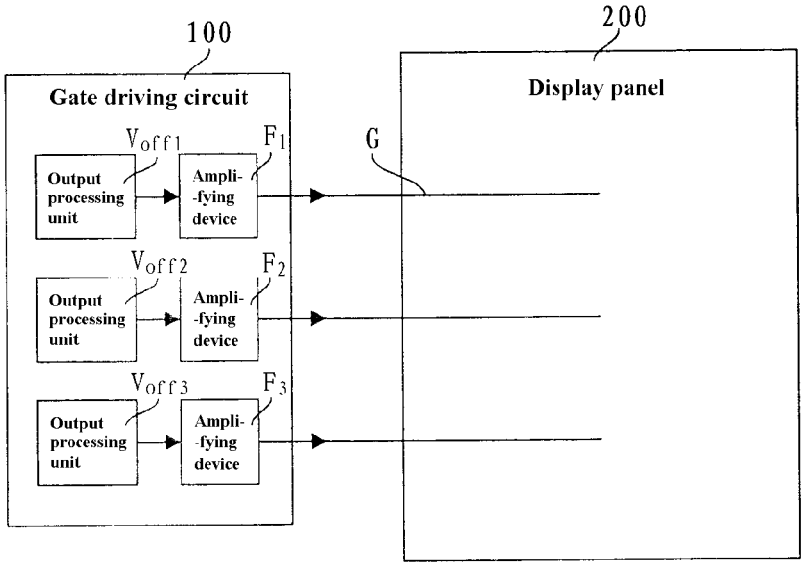
FIG. 5 is a structural schematic diagram of Embodiment 1 of the liquid crystal display of the invention.

FIG. 5 is a schematic diagram of Embodiment 1 of the liquid crystal display of the invention. The embodiment 1 includes a gate driving circuit 100 and a display panel 200, wherein the gate driving circuit comprises output processing units $V_{off}$1, $V_{off}$2, $V_{off}$3, and amplifying devices F1, F2, F3. The output processing units $V_{off}$1, $V_{off}$2, $V_{off}$3 are connected to the amplifying devices F1, F2, F3 one by one. The display panel comprises gate lines G. The amplifying devices F1, F2, F3 are connected to the gate lines G one by one.

When the amplifying devices in FIG. 5 are the feedback loops composed of the amplifier elements and feedback elements shown in FIG. 3, the amplifying devices can obtain expected output by automatic adjust of its internal circuit. When the preset levels in respective amplifying devices are set to the same, the same signals are output at different positions of the gate driving circuit such that the whole display panel receives the gate driving signals with identical value, and the gate driving signals received by the gate lines in the display panel keep consistent with each other to the most extent, thus the overall uniformity of the gate driving signals is improved, and the displaying deviation in the display panel is reduced. The imaging effect is improved, for example, the displaying chroma or luminance is more uniform, and the grey difference is reduced as great as possible, and the like.

Further, due to utilization of feedback amplifying loops, only the preset levels in various feedback amplifying loops are set identically, without the necessity of adjusting the amplifying multiple of the whole amplifier element individually, the same output may be obtained, thus the process effectiveness of module bonding is improved. However, the feedback adjusting procedure will extend processing time of signals in the gate driving circuit, so the driving signals input to the gate lines of the display panel 200 will have delay, and affect the display speed of the liquid crystal display. Thus in actual manufacture process, the computing speed of the feedback amplifying circuit should be increased. As such, the signal processing time in the gate driving circuit will be reduced to ensure outputting the driving signals in time.

Figure 6:
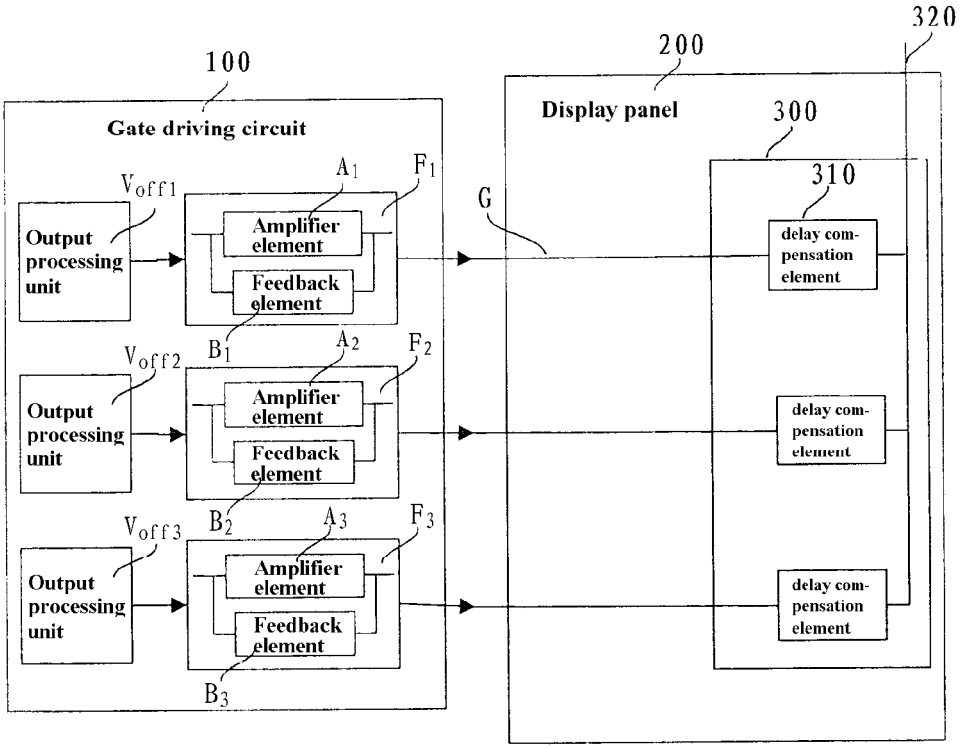
FIG. 6 is a structural schematic diagram of a preferred embodiment of the liquid crystal display of the invention.

Greater size and higher resolution of the liquid crystal display panel require the increase of density of the gate lines in the display panel, and also require longer gate line, which means increased resistance of the gate lines. Thus, the gate signals will be distorted due to delay. A signal delay compensator may be set at an end of the gate line to compensate for the above defect. FIG. 6 is a structural schematic diagram of a preferred embodiment of the liquid crystal display of the invention. This embodiment is different from the above embodiment 1 of the liquid crystal display of the invention in that the display panel 200 further comprises a signal delay compensator 300 which is connected to the gate line G. The delay compensator 300 includes: delay compensation elements 310 each of which is connected to the other end of the gate line; and compensation voltage transmission lines 320 connected to the delay compensation elements 310 for receiving a preset direct current from outside of the display panel and transmitting it to the delay compensation elements 310 at the same time.

In this embodiment, by setting the feedback amplifying loops at the output terminal of the gate driving circuit to ensure the same gate driving signals being provided at different positions of the gate driving circuit, when the density of the gate lines in the display panel is great, all the gate lines can obtain the same gate driving signals, thus the displaying uniformity on the display panel is obtained, for example, uniform chroma and uniform luminance are obtained. Besides, by setting the delay compensators connected to the gate lines, when the gate lines in the display panel are long, the delay compensators will compensate for the distortion of displaying in the display panel due to delay of the gate signals caused by the gate line resistance and capacitance.

It should be finally noted that the above embodiment is only used as a description to the technical solution of the invention but not as a limitation. Although the invention is described with reference to the preferable embodiments, those skilled in the art shall understand that the technical solution of the invention can be modified or equivalently alternated without departing from the spirits and scopes of the invention.

What is claimed is:

1. A gate driving circuit, comprising:

a plurality of output processing units outputting output signals having different voltage magnitudes due to resistance difference among the plurality of output processing units, and a plurality of amplifying devices each correspondingly connected to one output processing unit and each correspondingly directly connected to one of a plurality of gate lines, the plurality of amplifying devices amplifying the output signals in order to compensate for the difference in voltage magnitudes, and each of said amplifying devices configured for processing to amplify an output signal from the corresponding one output processing unit and then outputting the amplified signal as a driving signal to directly drive the corresponding one gate line to keep the driving signals received by the gate lines the same with each other in voltage magnitude so as to reduce difference among the output signals of output processing units.

2. The gate driving circuit of claim 1, wherein said amplifying device each comprises an amplifier element.

3. The gate driving circuit of claim 2, wherein said amplifying device each further comprises a feedback element, said feedback element being connected in parallel with said amplifier element to form a feedback loop.

4. A liquid crystal display, including:

a gate driving circuit comprising a plurality of output processing units outputting output signals having different voltage magnitudes due to resistance difference among the plurality of output processing units, and a display panel comprising a plurality of gate lines, wherein said gate driving circuit further comprises a plurality of amplifying devices each correspondingly connected to one of the output processing units and each correspondingly directly connected to one of the gate lines, the plurality of amplifying devices amplifying the output signals in order to compensate for the difference in voltage magnitudes, and each of said amplifying devices is configured to process to amplify the signals output from the corresponding one output processing unit and then output the amplified signal as a driving signal to directly drive the corresponding one gate line to keep the driving signals received by the gate lines the same with each other in voltage magnitude so as to reduce difference among the output signals of output processing units.

5. The liquid crystal display of claim 4, wherein said amplifying device each comprises an amplifier element.

6. The liquid crystal display of claim 5, wherein said amplifying device each further comprises a feedback element which is connected in parallel with said amplifier element.

7. The liquid crystal display of any one of claims 4-6, wherein said display panel further comprises a signal delay compensator connected to the gate line.

8. The liquid crystal display of claim 7, wherein said signal delay compensator comprises:

a delay compensation element correspondingly connected to the other end of the gate line; and a compensation voltage transmission line connected to the delay compensation element for receiving a preset direct current from outside of the display panel and transmitting it to the delay compensation element at the same time.

* * * * *